US005595512A

United States Patent [19]

Langdon

[11] Patent Number: 5,595,512

[45] Date of Patent: Jan. 21, 1997

[54] TILTED TERMINAL CLAMP

[75] Inventor: Howard S. Langdon, Winnetka, Ill.

[73] Assignee: The Fastron Company, Franklin Park, Ill.

[21] Appl. No.: 336,414

[22] Filed: Nov. 9, 1994

[51] Int. Cl.[6] ..... H01R 4/36

[52] U.S. Cl. ..... 439/812; 439/782

[58] Field of Search ..... 439/433, 434, 439/801, 810, 811, 782, 812

[56] References Cited

U.S. PATENT DOCUMENTS

| | | | |
|---|---|---|---|
| 2,946,039 | 7/1960 | Grunwald et al. | 439/801 OR |
| 3,993,397 | 11/1976 | Gutshall | 439/433 OR |
| 4,097,112 | 6/1978 | Veldman et al. . | |
| 4,269,464 | 5/1981 | Veldman . | |
| 4,310,214 | 1/1982 | Carlson | 439/801 X |

*Primary Examiner*—P. Austin Bradley
*Assistant Examiner*—Daniel Wittels
*Attorney, Agent, or Firm*—Fitch, Even, Tabin & Flannery

[57] ABSTRACT

A tilting terminal clamp having a clamping plate with a central, raised, frusto-conical annulus is provided with an aperture wall having a straight line portion to engage a retaining ring of a screw. This straight wall portion is preferably coined into the annulus aperture which has an upper, inclined wall portion of a greater diameter than the diameter of the straight portion in order to receive a fillet joining the head of the screw to the screw shank. To avoid cutting strands of wire from a clamped, stranded terminal wire, the lower peripheral edge is formed without a sharp burr edge, and a burr edge is formed on the upwardly facing side of the clamping plate. Increased holding power for gripping the terminal wire is provided by extending the serrations from the frusto-conical annulus to the outer peripheral edge of the clamping plate, and by making the serrations increasingly wider and deeper as they flare outwardly from the annulus to the outer, peripheral edge of the clamping plate.

7 Claims, 2 Drawing Sheets

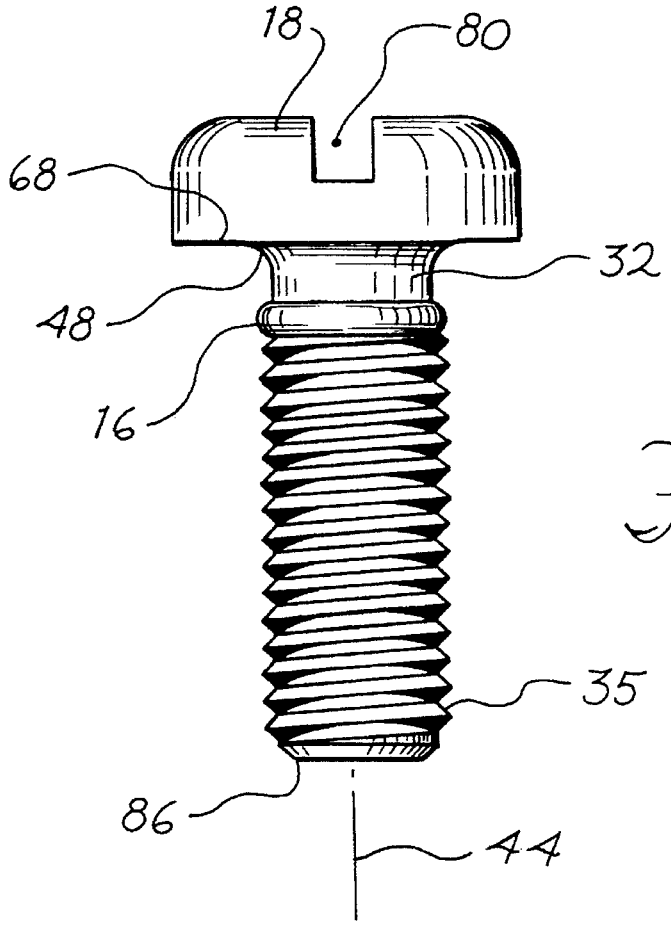
Fig. 4
Fig. 5
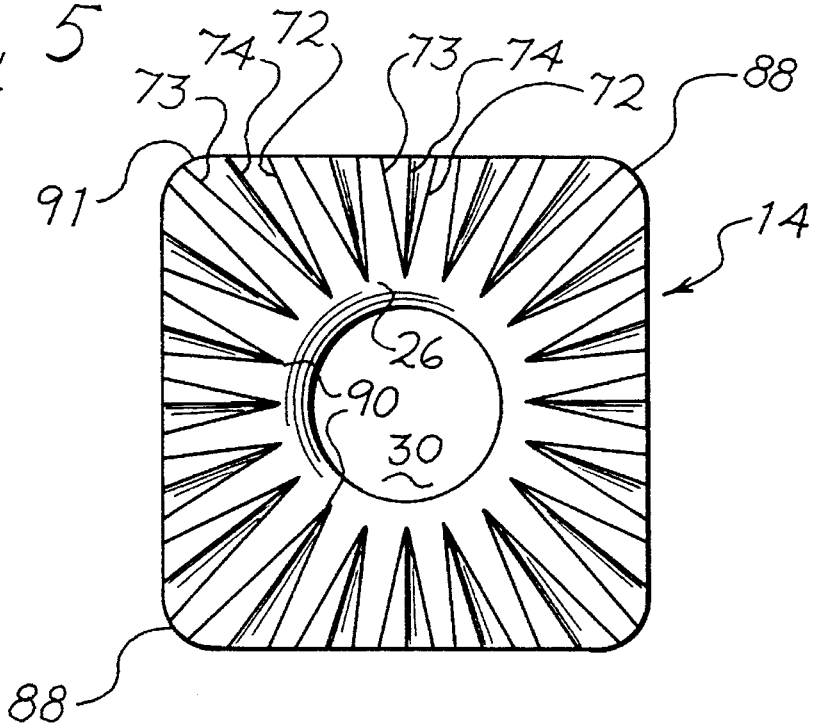

TILTED TERMINAL CLAMP

BACKGROUND OF THE INVENTION

This invention relates to a tilting terminal clamp having a threaded screw and a clamping plate mounted on the screw shank for securing wires at terminals, as used in the electrical and electronic industries.

Tilted clamps of the kind disclosed in U.S. Pat. Nos. 4,097,112 and 4,269,464 have been manufactured in large quantities and widely used because of their low-cost and easy use with automated assembly techniques. These tilted clamps have a screw formed with an enlarged head at one end adjacent a clamping plate that is mounted on an unthreaded shank portion of the screw. An enlarged collar or ring on the screw shank abuts the underside of the clamping plate and retains the clamping plate against sliding downwardly along the threaded shank of the screw. As shown in FIG. 3 of U.S. Pat. No. 4,269,464, the center portion of the clamping plate has a raised frusto-conical annulus. In the center of this frusto-conical annulus, there is a central aperture larger in diameter than the adjacent, encircled portion of shank to permit the clamping plate to tilt on the screw shank. The aperture's wall is inclined, and its lower edge defines the minimum diameter for the aperture. While these tilting terminal clamps have been very successful, the clamping plate, in some instances, has slid past the retaining ring and either partially down the threaded shank or slid off the shank. Such instances are undesirable particularly when the tilting terminal clamp is being handled and assembled with automatic equipment.

The clamping plate of the tilted terminal clamps are small metal pieces that are stamped with dies from metal strip stock. It has been found that a burr edge is formed on the lower peripheral edge of the stamped clamping plate; and that this burr edge could, in some instances, cut off strands from a stranded terminal wire. In electrical and electronic assembly, it is undesirable that the clamping plate cut strands from the wire because these small pieces could be dislodged into the electronics or catch fire. Thus, there is a need for remedying this problem in a low cost and efficient manner.

SUMMARY OF THE INVENTION

In accordance with the present invention, the clamping plate of the tilting terminal assembly is provided with an improved, aperture wall that prevents the clamping plate from sliding past the retaining ring on the shank of the screw. This is achieved by forming the aperture with a compound shape including a straight portion of a significant width that will not slide past the retaining ring on the screw shank. In the illustrated embodiment of the invention, the straight wall portion of the aperture is substantially long relative to the thickness of the clamping plate, e.g., about 0.035 to 0.040 inch. Preferably, the straight wall portion is coined into the aperture wall. Above the straight wall portion is an inclined, large diameter, wall portion to receive therein a fillet joining the shank to the screw head. The enlarged, retaining ring on the screw has a nominal diameter of about 0.004 to 0.005 inch greater than the smallest aperture diameter. The annular ring is rolled on the shank with rolling dies. Because the straight wall portion provides a much longer surface than a line contact, the clamping plate will not slide down the shank when the rolled ring is slightly below its nominal diameter.

In accordance with another important aspect of the invention, an outer burr edge on the lower side of the clamping plate that sometimes cuts strands of a stranded terminal wire has been eliminated. Preferably, this downward burr edge has been replaced by an upwardly curved, rounded edge. This has been achieved by stamping the clamping plates from the metal in the reverse direction so that the burr edge caused by the stamping process faces upwardly.

BRIEF DESCRIPTION OF THE DRAWINGS

FIG. 4 is an enlarged, fragmentary view of the lower and upper peripheral edges of the clamping plate; and FIG. 5 is an enlarged plan view of the clamping plate.

DETAILED DESCRIPTION OF THE PREFERRED EMBODIMENT

Figure 1:
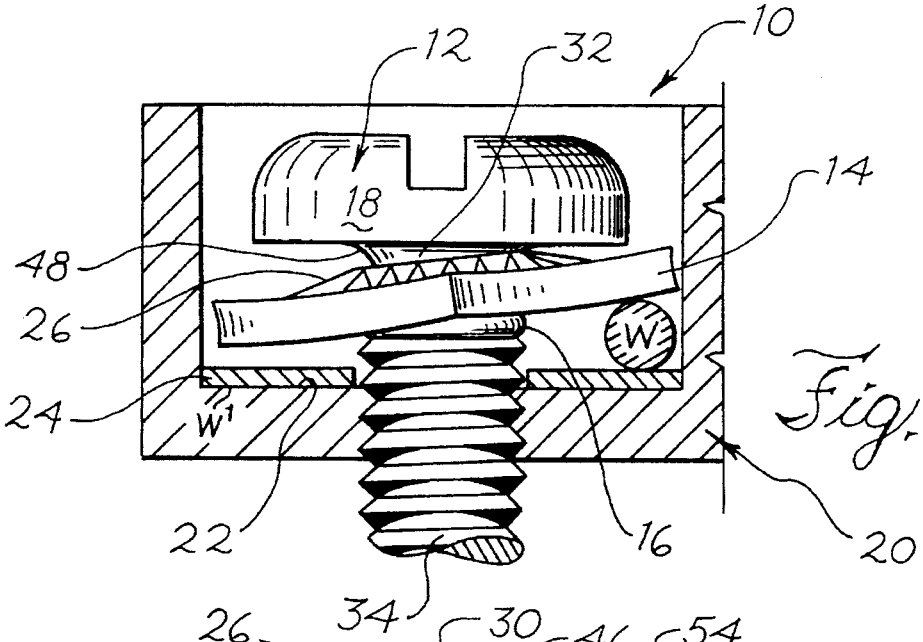
FIG. 1 illustrates a tilting terminal clamp embodying the novel features of the invention.

As shown in the drawings for purposes of illustration, the invention is embodied in a tilting terminal clamp 10 having a screw 12 with a clamping plate 14 mounted on the screw and retained thereon by an annular ring or collar 16. The screw has a head 18 which is to be driven into a terminal body 20 having a bottom wall 22 supporting a plate-like terminal 24 against which wire leads W and W' may be clamped by the tilted clamping plate, as best seen in FIG. 1.

Figure 3:
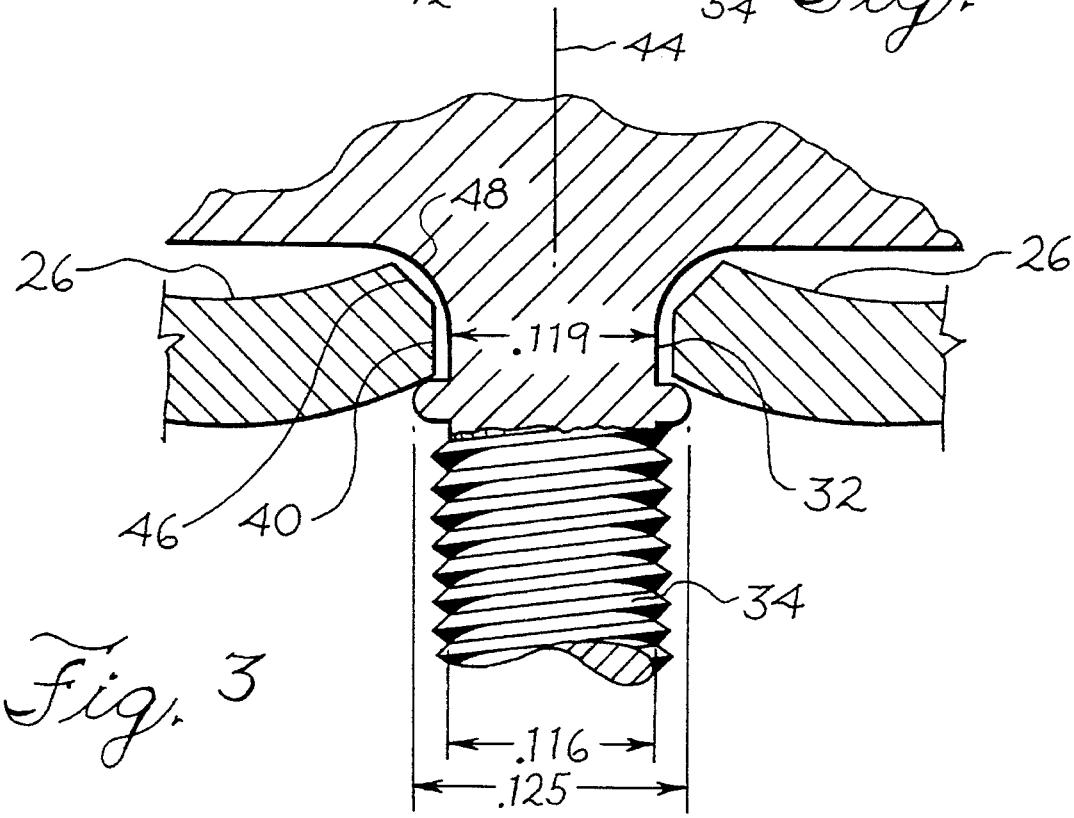
FIG. 3 is an enlarged, elevational cross-sectional view of the preferred screw.

To assist in tilting the clamping plate 14 to give the desired clamping effect, the clamping plate is formed with a frusto-conical annulus 26 that projects upwardly from a central portion of a flat plate body 28. In the center of the upwardly projecting annulus is a central aperture 30, which is defined by a wall 31, (FIG. for encircling an upper, unthreaded portion 32 of a shank 34 of the screw 12, as shown in FIG. 3. The shank 34 has a screw 35 rolled thereon. The aperture is sized large enough to allow tilting of the clamping plate about the shank unthreaded portion 32 and small enough to prevent the sliding of the clamping plate down the shank past the retaining ring 16. As shown in FIG. 3 of U.S. Pat. No. 4,269,464, the aperture has its defining wall larger in diameter at the top, and then inclined downwardly to a smallest diameter at a lower edge of the aperture in the bottom surface of the annulus. The annular retaining ring is rolled onto the shank after the clamping plate was slid on the screw blank. The tolerances between this smallest diameter at the line contact between the aperture defining wall and the retaining ring were such that, in some instances, the clamping plate would slide down past the retaining ring and be located partially down the shank or be completely separated from the screw shank. Such occurrences are particularly undesirable where automatic terminal fastening equipment is handling and using these tilted terminal clamp assemblies.

In accordance with the present invention, the aperture 30 is provided with an improved shape to retain the clamping plate on the screw while still allowing the tilting action on the screw shank. This is achieved by forming the aperture 30 in the annulus 26 with a straight portion 40 in the aperture wall 31 that will provide a long surface. The straight wall 40 is coined in a separate stamping operation to be precisely dimensional. The flat, straight wall portion 40 is an annular surface that extends parallel to an axis 44 through the screw when the body of the plate washer is disposed normal to the screw axis, as shown in FIG. 3. Above the straight wall portion 40 is an inclined, upper portion 46 (FIG. 4) of the aperture 30 which is inclined to the axis 44, as was the entire aperture in the frusto-conical annulus of prior art clamping plates. The inclined upper portion 46 has a larger diameter to receive therein a fillet 48 which joins the screw head 18 to the shank 34.

Also, in accordance with an important aspect of the invention, the clamping plate 14 is formed with a smooth, rounded, lower edge or corner 50 (FIG. 2) at the bottom of a peripheral vertical wall 51; and this rounded edge 50 engages the wire without cutting the wire W or W'. The clamping plate 14 has a burr edge 52 facing upwardly away from the wire so that it cannot cut any strands of a stranded wire W or W'. The burr edge 52 is shown exaggerated in FIG. 2 and is usually only about 0.001 to 0.005 inch in height. The burr edge is sharp and is formed when punching the clamping plates from sheet metal stock.

In accordance with a further aspect of the invention, greater and better clamping of the wires W and W' are achieved than in the construction shown in U.S. Pat. No. 4,269,464 by having deeper and longer serrations 54 in the clamping plate. In the above-mentioned patent, the serrations stopped short of the peripheral edge wall 51 leaving a flat, unserrated border. In this invention, it is preferred that the serrations 54 extend outwardly through the outer edge of the clamping plate as best seen in FIG. 5, and increase progressively in depth from the inner ends 90 of the serrations to the outer edges 91. Thus, by increasing the length of the serrations, the maximum depth of serrations may also be increased.

Figure 2:
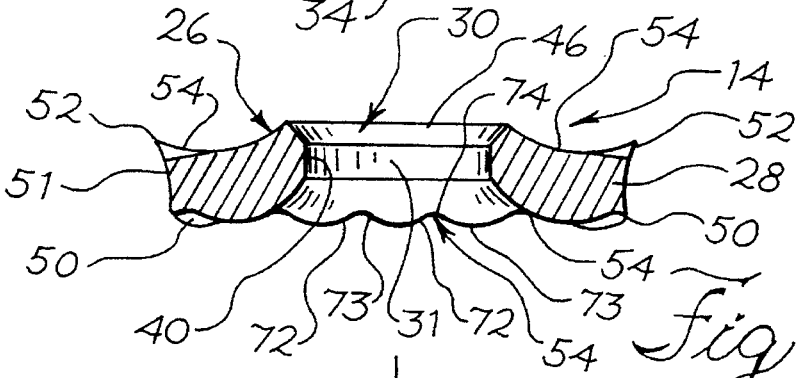
FIG. 2 is an enlarged cross-sectional view of the clamping plate used in the terminal clamp assembly of FIG. 1.

Referring now in greater detail to the illustrated embodiment of the invention, the invention is embodied in a clamping plate 14 which has the generally flat, polygonal shaped body 28 with the annulus body portion 26 being inclined upwardly, as shown in FIG. 2.

The annulus portion is upstruck at the center of the clamping plate body 28 by a punch press prior to the formation of the aperture 30 therein. At the next station in the punch press, or die operation, the aperture 30 is formed; and this is done by first cutting the aperture so that it is formed with an entire inclined wall 46; and then coining the lower portion of the aperture wall to provide the long, flat, straight portion 40 which is at an angle to the upper portion. That is, a separate, extra coining operation is preferably used to make the flat portion 40 so as to make it to a precise dimension that will always be less than the diameter of the retaining ring 16. As best seen in FIG. 3, the upper, enlarged diameter, wall portion 46 above the straight wall portion 40 is sized to receive therein the fillet 48 which joins a top end of the shank 32 to the underside 68 (FIG. 4) of the screw head 18. This enlarged area, defined by the wall portion 46 of the aperture, allows the pivoting or the tilting of the clamping plate at the location of the fillet 48, as shown in FIG. 1. By way of example only, for a number 6 terminal clamping screw, the screw blank had a shank diameter prior to the rolling of the screw thread 35 of 0.116 inch; and the diameter of the flat portion 40 of the aperture 30 was between 0.119 to 0.120 inch after coining. The typical height of the flat portion 40 that is coined into the aperture is in the range of about 0.035 to 0.040 inch. The outer diameter of the retaining ring 16 is about 0.125 inch. Typically, the difference between the diameter of the blank and the diameter of the straight portion 40 is about 0.004 to 0.005 inch. Manifestly, for different sizes of screws the dimensions will change as will the particular tolerances.

The holding power of the serrations 54 is increased by extending the serrations 54 to outer peripheral edge 51 of the polygonal-shaped clamping plate. Herein, the polygonal shape is formed with four (4) sides although other numbers of sides could be used. The serrations are in the form of V-shaped depressions having inclined sidewalls 72 and 73 (FIG. 2) in the top and bottom walls of the plate body 28 of the blank extending generally from inner ends 90 (FIG. 5) adjacent the bottom of the annulus 26 out to the outer peripheral edge 51 of the clamping plate.

As best seen in FIG. 2, the depth of the serration 54 increases from the serration of the inner end at 90 to the outer edge 91 at the edge 51 of the clamping plate. As best seen in FIG. 5, the sidewalls 72 and 73 after the serrations flare outwardly from one another to define a triangular shape extending from a narrow end 90 at the annulus to a wide end 91 at the edge 51 of the clamping plate. The sidewalls 72 and 73 meet at an inner juncture line 74 at the bottom of the serration. These serrations 54 are formed on both the top and bottom sides of the clamping plate. The serrations provide a serrated, gripping surface to grip and hold the wires W and W' with a good holding force when the screw is tightened. The holding or clamping power to retain the lead is an important consideration to passing standards, such as Underwriter Laboratory's standards.

The screw has the head 18 formed typically with a slot 80 therein or other configuration which assists in an automatic driving of the screw. The screw thread 35 is formed on the shank of the screw by a rolling operation in the usual manner after clamping plate has already been attached. As above explained, the retaining ring 16 is also rolled into the shank 34 of the blank of the screw after the clamping plate has been attached. The screw may of any particular configuration and has a lead-in end 86 (FIG. 4) which can be threaded as shown in FIG. 1, through the terminal wall 20.

The clamping plate 14 often is used to contact two wires W and W' of different diameters. The clamping plate may be tilted so as to be able to clamp a wire W' which has a diameter smaller than the height of the annular ring.

From the foregoing, it will be seen there is provided a new and improved tilting terminal clamp which includes an improved construction of annulus having a flat portion within the aperture wall. Additionally, the plate is formed with a smooth, outer edge on its lower side so as not to cut strands from the wire while a burr edge projects upwardly in the same direction as the frusto-conical portion of the clamping plate. The deeper serrations extending out to the edge of the clamping plate allows better holding action than when an unserrated border was provided as in the prior art.

What is claimed is:

1. A tilting terminal clamp comprising:

a threaded screw having a longitudinal axis and a threaded shank;

a head for turning the screw at one end of the shank and a lead-in at the other end of the screw shank;

a fillet formed on the screw joining the head to the shank;

an annular retaining ring on the screw shank spaced at a predetermined distance from the head;

a tiltable clamping plate having a central aperture encircling the screw shank between the annular retaining ring and the head of the screw;

a lower serrated surface on the clamping plate to engage a wire;

a frusto-conical annulus formed in the central portion of the clamping plate;

a lower concave surface on the lower side of the frusto-conical annulus for abutting the retaining ring of the screw;

a wall defining an aperture in the frusto-conical annulus including a coined straight wall portion extending parallel to the longitudinal axis of the screw and encircling the shank and having a diameter less than the diameter of the retaining ring to retain the plate on the screw; and an upper inclined portion on the wall defining the aperture located above the coined straight wall portion and extending outwardly therefrom at an angle and located adjacent the fillet and sized to receive therein the fillet.

2. A tilting terminal clamp in accordance with claim 1 wherein the height of the vertical wall portion is at least 0.035 inch.

3. A tilting terminal in accordance with claim 1 wherein a sharp edge is formed on the upper side of the terminal plate facing the screw head so as not to cut into the wire being clamped.

4. A terminal clamp in accordance with claim 1 in which the serrations extend generally radially outwardly from the frusto-conical annulus to a peripheral outer edge of the clamping plate; the serrations becoming deeper and wider as they extend toward the outer edge of the plate.

5. A tilting terminal clamp comprising:

a threaded screw having a longitudinal axis and a threaded shank;

a head for turning the screw at one end of the shank and a lead-in at the other end of the screw shank;

a fillet formed on the screw joining the head to the shank;

an annular retaining ring on the screw shank spaced at a predetermined distance from the head;

a tiltable clamping plate having a central aperture encircling the screw shank between the annular retaining ring and the head of the screw;

a lower serrated surface on the clamping plate to engage a wire;

a frusto-conical annulus formed in a central portion of the clamping plate having a lower concave surface to receive a portion of the retaining ring therein;

a wall defining an aperture in the frusto-conical annulus surrounding the shank of the screw;

an upper inclined portion on the wall for receiving the fillet therein;

a straight lower portion on the wall located below the upper inclined wall and extending parallel to the axis of the screw preventing the clamping plate from sliding down past the retaining rug;

the upper inclined portion on the wall defining the aperture located above the straight lower portion on the wall and extending outwardly therefrom at an angle and located adjacent the fillet and sized to receive therein the fillet; and a burr upper edge on the upper side of the clamping plate facing the screw head and a lower and smoother edge on the lower side of the plate to engage a terminal wire without cutting the same.

6. A tilting terminal clamp in accordance with claim 5 including serrations in a lower side of the clamping plate extending from the annulus to an outer peripheral edge for the clamping plate.

7. A tilting terminal clamp in accordance with claim 6 wherein the straight wall has a length of 0.035 inch or greater.

* * * * *